United States Patent [19]

Grosfilley et al.

[11] Patent Number: 4,844,641

[45] Date of Patent: Jul. 4, 1989

[54] DISPOSABLE TOOTHBRUSH WITH A DOSE OF TOOTHPASTE

[76] Inventors: Jean-Pierre Grosfilley, 14 route de la Forge, Oyonnax, Ain; Jean-Louis Dumoulin, 13 avenue Denis Delorme, Charbonnieres les Bains (Rhone), both of France

[21] Appl. No.: 78,938

[22] Filed: Jul. 29, 1987

[30] Foreign Application Priority Data

Aug. 1, 1986 [FR] France ..... 8611648

[51] Int. Cl.[4] ..... A46B 11/02

[52] U.S. Cl. ..... 401/176; 401/132; 401/171; 401/160; 401/268; 401/269; 401/275; 401/286

[58] Field of Search ..... 401/132, 176, 269, 181, 401/160, 171, 268, 275, 286

[56] References Cited

U.S. PATENT DOCUMENTS

| | | | |
|---|---|---|---|
| 1,653,540 | 12/1927 | Bigoney | 401/269 X |
| 2,090,144 | 8/1937 | Palimeri et al. | 401/176 X |
| 2,550,190 | 4/1951 | Greenberg . | |
| 2,774,982 | 12/1956 | Reed . | |
| 3,536,410 | 10/1970 | Wargoe . | |
| 3,589,823 | 6/1971 | Hendrickson | 401/176 |
| 4,408,920 | 10/1983 | Walther et al. | 401/176 |
| 4,588,089 | 5/1986 | Yanz, Jr. et al. . | |

FOREIGN PATENT DOCUMENTS

| | | | |
|---|---|---|---|
| 270394 | 2/1914 | Fed. Rep. of Germany . | |
| 1161639 | 9/1958 | France . | |
| 2550429 | 2/1985 | France . | |
| 2579874 | 10/1986 | France | 401/132 |
| 512130 | 7/1956 | Italy | 401/132 |
| 237359 | 8/1945 | Switzerland | 401/160 |

*Primary Examiner*—Steven A. Bratlie
*Attorney, Agent, or Firm*—Browdy and Neimark

[57] ABSTRACT

A disposable toothbrush comprises a toothbrush body having bristles, and a toothbrush back containing a dose of toothpaste. The toothpaste is isolated from the bristles by a protective film. A safety cap retains the toothbrush back separate from the toothbrugh body. Removal of the cap allows the back to approach the body, which causes tearing of the protective film and distribution of the toothpaste onto the bristles.

10 Claims, 4 Drawing Sheets

DISPOSABLE TOOTHBRUSH WITH A DOSE OF TOOTHPASTE

FIELD OF THE INVENTION

This invention relates to a toothbrush in which a dose of toothpaste is stored.

BACKGROUND OF THE INVENTION

Toothbrushes have already been envisaged that can be used away from home, for example on a trip, or offered in establishments receiving the public, which could be used once, without the need of having a separate tube of toothpaste, because of a sufficient dose of toothpaste incorporated in the brush for brushing the teeth. In a particularly practical system, already proposed, the toothbrush comprises means which, at the time of using this brush, make it possible to distribute the dose of toothpaste directly onto the bristles of the brush.

However, known means of distribution of the toothpaste lead to rather complex, therefore expensive, embodiments, yet without assuring perfect cleanness and safety by total isolation of the dose of toothpaste before use, while avoiding any risk of undesired escape of the paste. Moreover, the distribution of the toothpaste on the bristles is generally provided by pressing a flexible part which does not permit the totality of the dose to be distributed.

SUMMARY OF THE INVENTION

This invention eliminates all these drawbacks, by providing a toothbrush of great simplicity, which can be produced at low cost which is essential for an article used only once, and in which the dose of toothpaste is perfectly isolated until the moment of using the brush.

For this purpose, the disposable toothbrush, the object of the present invention, essentially comprises, a brush body carrying bristles and pierced with at least one passage in the area of the bristles and, to be mobile in relation to the body of the brush and provided, in the area of the brush head, with a cavity filled with a dose of toothpaste and initially closed by a protective film, the brush body having a part complementary to said cavity which, during movement of the back relative to the body, comes to tear the protective film and expels the toothpaste toward the bristles through the passage or passages.

Thus, the disposable toothbrush according to the invention can be made from two main elements, which can be plastic pieces molded by injection, the bristles capable of being molded directly with the brush body. The dose of toothpaste is stored in a cavity which is easy to fill during production, and this dose is perfectly isolated by a protective film, for example, heatsealed. During use of the toothbrush, a single movement suffices to tear the protective film and distribute in the same movement the entire dose of toothpaste between the bristles of the brush.

More particularly, the brush body and the brush back are connected to one another by articulation of their parts forming the handle of the brush, and preferably toward the free end of the handle, so that a slight pivoting of the back in relation to the body, bringing these elements closer together, causes tearing of the protective film and distribution of the toothpaste.

According to a particular embodiment of this toothbrush, the body comprises, in the area of the brush head and on the face opposite the bristles, a longitudinal ridge provided to tear the protective film, the passages for the distribution of the toothpaste having their starting points located on the ridge in question. This ridge preferably belongs to a part of the brush body with a V profile, complementary to that of the cavity containing the dose of toothpaste, which assures the expulsion of all the paste.

Almost absolute safety is obtained by also providing means which, before use of the brush, keep the body and back in a slightly separated position, so that the part serving to tear the protective film is kept at a distance from this film.

These means are advantageously made up of a removable safety cap which, when put in place, covers at least the brush head, the cap interiorly comprising arrangements, such as grooves and/or ribs, which work with the complementary parts belonging to the brush body or brush back, to maintain these two elements at a determined spacing, before use of the brush. The safety head can also be made, with its inside grooves and/or ribs, of plastic molded by injection. Removal of this cap is performed by sliding in the direction of the grooves and/or ribs, two possibilities being offered:

in a first case, after removal of the cap, the back is moved manually in the direction of the brush body to tear the protective film and distribute the toothpaste;

in the second case, is shaped like a slider whose removal causes a bringing together of the back in relation to the body, accompanied by tearing of the protective film and distribution of the toothpaste.

The removable cap can be shaped like a cap that can be used after being removed from the brush.

In another embodiment, means are provided which, before the brush is used, keep the body and back in slightly separated position. This means comprises a tongue that can be pulled out, inserted between the body and back in the area of the brush head, the tongue being initially attached to the body or back. In this case, the safety cap becomes unnecessary.

In another characteristic of the invention, locking means are further provided on the brush body and on the brush back, to secure these two elements in relation to one another in their relative position of maximum approach. Thus, after distribution of the totality of the dose of toothpaste on the bristles, the brush forms a rigid unit which can be held perfectly in the user's hand, and any movement opposite to that which has caused the distribution of the paste is made impossible.

BRIEF DESCRIPTION OF THE DRAWINGS

In any case, the invention will be better understood from the following description, with reference to the accompanying diagrammatic drawing representing, by way of nonlimiting examples, some embodiments of this disposable toothbrush with dose of toothpaste.

DETAILED DESCRIPTION OF THE INVENTION

Figure 1:
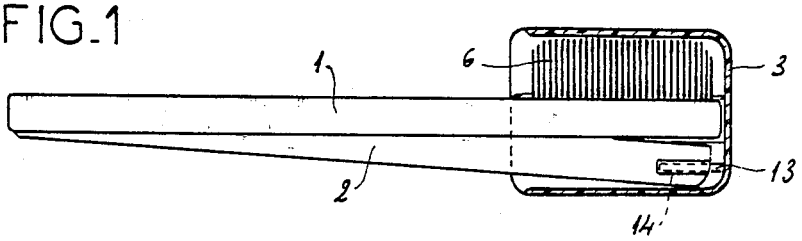
FIG. 1 is a side view of a toothbrush according to the invention, before use, the safety cap being indicated in section.
Figure 2:
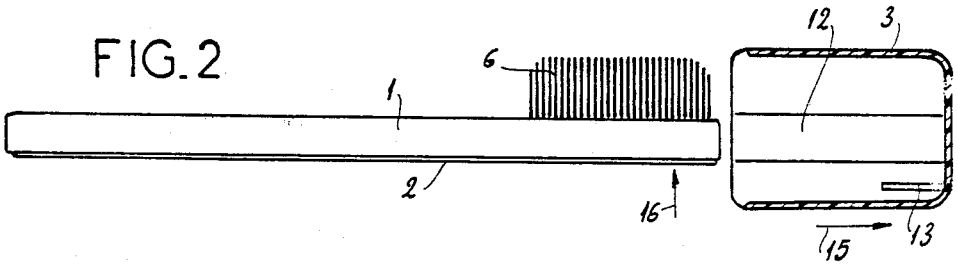
FIG. 2 is a side view similar to FIG. 1, but showing the toothbrush in use position, the safety cap having been removed.

The complete disposable toothbrush represented in FIGS. 1 and 2 is made up of a main body 1 and a back 2, and it also comprises, at least before it is used, a safety cap 3, all these elements being made of plastic molded by injection, having a certain flexibility.

Brush body 1 and brush back 2 both extend over the entire length of the toothbrush to form the handle and head of this brush.

Figure 3:
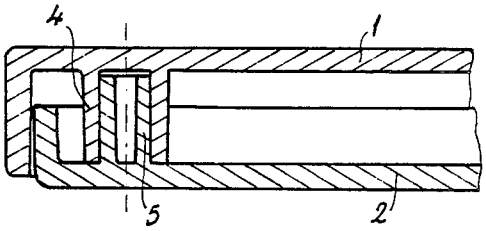
FIG. 3 is a view in longitudinal section, on an enlarged scale, showing the detail of the end of the handle of this toothbrush.

The parts of body 1 and back 2 which form the handle of the brush are fitted into one another, and are articulated together at the free end of this handle, to permit a slight relative angular movement. For this purpose, as shown in FIG. 3, body 1 comprises on the inside a duct 4, in which is introduced a pin 5 formed on the inside of back 2. Because of this articulatd connection, body 1 and back 2 can be slightly separated, or tightened, in the area of the brush head.

Figure 4:
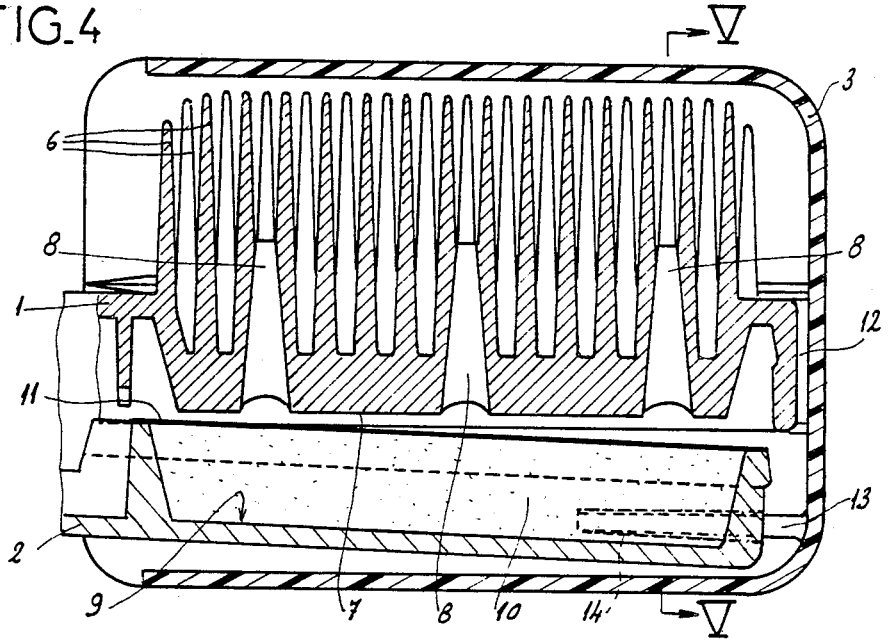
FIG. 4 is a view in longitudinal section, along IV—IV of FIG. 5, showing the detail of the head of the toothbrush, before use.
Figure 5:
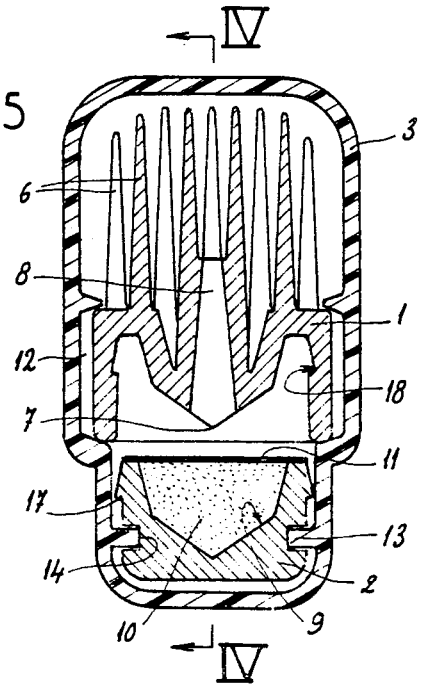
FIG. 5 is a view in cross section of this head, along V—V of FIG. 4, still corresponding to the position before use.
Figure 6:
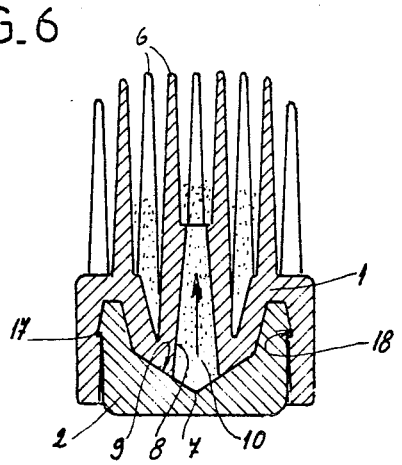
FIG. 6 is a view in cross section similar to FIG. 5, but corresponding to the position of use of the toothbrush.

In its part forming the brush head, body 1 carries on its upper surface, a set of bristles 6, which can be molded directly with body 1, and which exhibit, for example, a staggered arrangement, the detail of bristles 6 being seen in FIGS. 4 to 6.

Still in the area of brush head, body 1 exhibits, on its lower face, a V profile with a middle ridge 7, oriented longitudinally. Body 1 is pierced with several passages 8, which have their starting points on middle ridge 7 and which come out between bristles 6.

Back 2 comprises, in the area of the brush head, a cavity of V profile which is filled with a dose of toothpaste 10. On the ridge of cavity 9 is initially sealed a protective film 11, for example of aluminum, which closes this cavity 9 and which isolates toothpaste 10 in relation to the outside medium.

Before use of the toothbrush, body 1 and back 2 are slightly separated in the area of the brush head so that ridge 7 is kept at a distance from film 11 -- see FIGS. 1, 4 and 5. This initial position is maintained by means of safety cap 3, which covers and protects the entire brush head, this cap 3 being open only one side. Safety cap 3 exhibits, inside, two longitudinal grooves 12, placed opposite one another, in which the lateral parts of body 1 are introduced and held. Further, cap 3 exhibits, on the inside, two ribs 13 located opposite one another, which are engaged in corresponding hollow grooves 14 on the sides of back 2.

At the moment of use of this toothbrush, safety head 3 is first removed, as shown by FIG. 2 (arrow 15), which frees parts 1 and back 2 forming the brush head. Then, the user exerts a pressure on the back along arrow 16 to fit back 2 entirely into body 1. In this movement, ridge 7 approaches protective film 11, tears this film then penetrates into cavity 9 as FIG. 6 shows. Toothpaste 10 is then expelled from cavity 9, flowing through passages 8, and it is distributed between bristles 6 of the brush. The complementary profiles of cavity 9 and of the part of body 1 comprising ridge 7 make it possible to expel all the dose of toothpaste 10.

When back 2 is fitted entirely into body 1, securing in the final position is obtained by locking, because of complementary shapings 17 and 18 provided, on the one hand, on the sides of back 2 and, on the other hand, on the inside faces of body 1.

Bringing the toothbrush into this final position makes it possible to use it for one brushing, after which the brush is thrown away.

Figure 7:
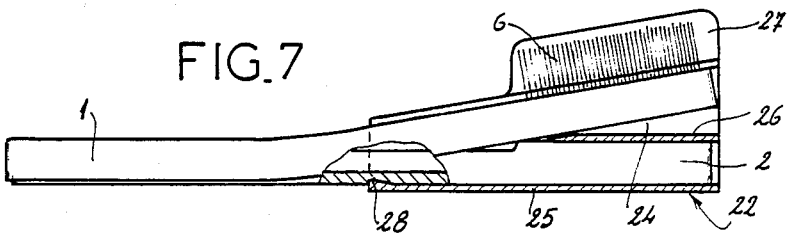
FIG. 7 is a side view, with partial section, of a toothbrush according to the invention with safety cap shaped like a slider causing the back to come closer in the direction of the body.
Figure 8:
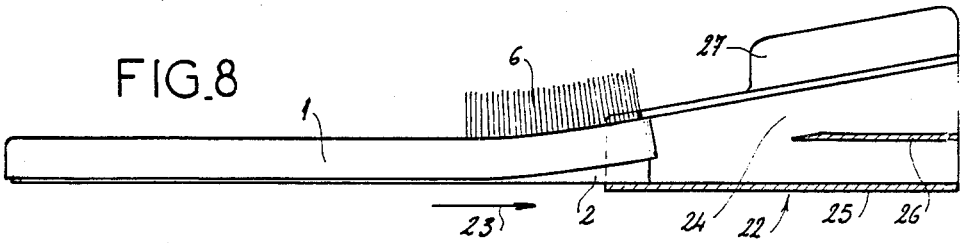
FIG. 8 is a side view similar to FIG. 7, but showing the slider during removal.
Figure 9:
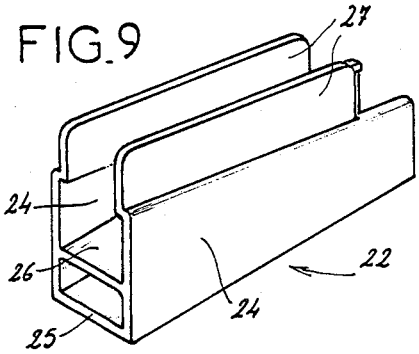
FIG. 9 represents, in perspective, the slider of the toothbrush according to FIGS. 7 and 8.

FIGS. 7 to 9 show a first variation, in which the safety cap is shaped like a slider 22, in the shape of a wedge. Slider 22 is initially placed at the level of the head of the toothbrush, as FIG. 7 shows. At the moment of use of the toothbrush, slider 22 is removed manually by a pull along arrow 23, causing back 2 and body 1 to come close together by deformation of body 1 which is flexible—see FIG. 8. This coming together causes tearing of protective film and the distribution of the toothpaste between bristles 6 of the brush.

FIG. 9 shows slider 22 alone. It has two lateral faces 24, trapezoidal in shape, connected to one another by a lower face 25, as well as by an inside partition 26. Before use of the toothbrush, the ends of body 1 and back 2 of the brush are kept separated from one another by slider 22, being separated from one another by partition 26, which avoid any undesirable tearing of the protective film -- see also FIG. 7.

Optionally, the two lateral faces 24 of slider 22 are extended by wings 27 which, in the initial assembly position of slider 22, are placed on both sides of bristles 6 of the toothbrush, and assure their protection before this brush is used. Wings 27 can be connected by an additional face to form a "tunnel" protecting bristles 6 entirely.

The back end of slider 22 is stopped, in its initial assembly position, by a check notch 28. This notch 28 positions slider 22, and forces the user to pull slider 22 in the "good" direction, i.e., in the direction of arrow 23 at the moment of using the toothbrush.

Finally, it should be noted that cap 3 or slider 22 can be made of opaque plastic or of transparent plastic leaving body 1 and back 2 of the toothbrush visible and permitting its identification.

Figure 10:
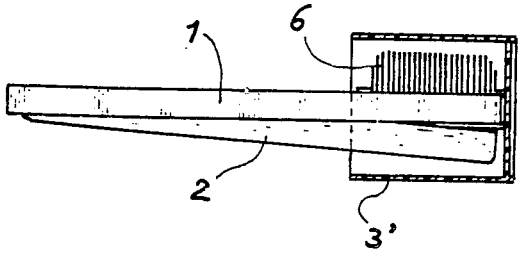
FIG. 10 is a side view, similar to FIG. 1, showing a variant of the toothbrush, with safety cap shaped like a cup.

FIG. 10 shows another variant, in which safety cap 3', which still performs the function described above, is further shaped to constitute a cup, particularly by increased dimensions and more rounded shapes.

Figure 11:
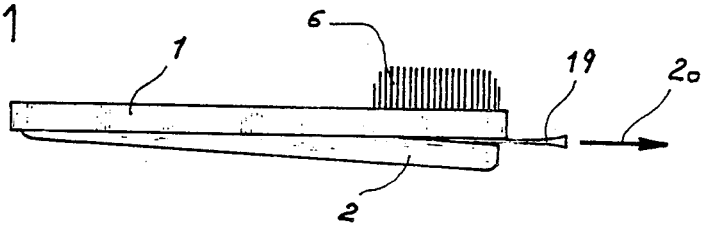
FIG. 11 is a side view showing another embodiment, without safety cap but with tongue that can be pulled out.
Figure 12:
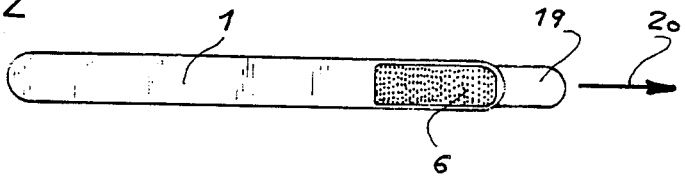
FIG. 12 is a top view of the toothbrush of FIG. 11.

FIGS. 11 and 12 represent another embodiment, not having the safety cap, the function of this latter being provided by a tongue 19 that can be pulled out. This tongue 19, attached, for example, to the body of brush 1 and extending in front of the head, is initially inserted between body 1 and back 2, to keep them slightly separated. At the moment of use of the toothbrush, tongue 19 is pulled out by a pull along arrow 20, which allows back 2 to approach body 1 to release and distribute the dose of toothpaste.

Figure 13:
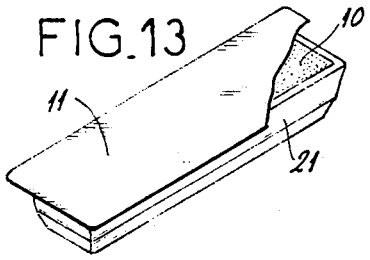
FIG. 13 is a perspective view of a dose of toothpaste intended for the toothbrush, object of the invention.
Figure 14:
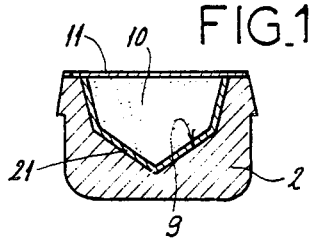
FIG. 14 is a view in cross section going through the back of the toothbrush and through the toothpaste according to figure 13 placed in the cavity of this back.

Finally, FIGS. 13 and 14 show a particular embodiment advantageous for doses of toothpaste, making it possible to make up these doses in advance then place them in the backs of the brushes, provided with a corresponding cavity, without filling or sealing. Each dose is like a small hot-formed pocket 21 containing toothpaste 10 and blocked by a protective film 11, for example of aluminum sealed on its edge, after filling—see FIG. 13. Unit doses can be obtained by cutting from a plate allowing the simultaneous production of a large number of doses. Each unit dose, cut precisely as a function of the shapes and dimensions of the toothbrush, is assembled by fitting into cavity 9 of back 2 of the brush—see FIG. 14.

The solution proposed here makes it possible to envisage the prefabrication of doses at the toothpaste producer and their being put in place by the toothbrush manufacturer. This solution does not at all modify the functioning of the toothbrush, toothpaste 10 stil being maintained by a protective film 11 which is torn at the moment of use to release toothpaste 10 and distribute it between the bristles of the brush.

Regardless of the embodiment of the doses, tearing of protective film 11 can be facilitated by adding on center ridge 7 at least one barb which makes a start in the tearing of the film.

This toothbrush can be packaged in a hermetically sealed bag, assuring perfect cleanliness. It can be used individually, for example, by a person going on a trip, or by distributed collectively in restaurant services or else for advertising.

Of course, the invention is not limited to the sole embodiments of this disposable toothbrush that have been described above; rather, it takes in all variant embodiments that respect the same principle, regardless of the forms of detail that may be given to the various elements of this brush.

We claim:

1. A disposable toothbrush including a dose of toothpaste comprising:

a brush body having a front end and a back end, said brush body provided with bristles;

at least one passage in said brush body in the area of the bristles;

said brush body including, in the area of the brush head and on the face thereof opposite the bristles, a longitudinal ridge and passsages for the distribution of toothpaste located on said ridge;

said ridge having a profile which is complementary to a profile of a cavity containing the dose of toothpaste;

a brush back mounted at the back end of said brush body in transverse mobile relation to said brush body;

a brush head at the front end of said brush body;

said brush back provided near the front end thereof with a cavity filled with a dose of toothpaste;

said toothpaste being protected by a protective film;

said brush body having a part complementary to said cavity, said part being adapted and constructed to tear said protective film and expel toothpaste toward said bristles;

said brush body and said brush back being connected to one another by articulations in their parts;

whereby a light relative pivoting of said brush back in relation to said brush body causes tearing of the protective film and distribution of the toothpaste onto the bristles.

2. The toothbrush according to claim 1 wherein said brush body and said brush back are made of injection molded plastic, and said bristles are molded directly with said brush body.

3. The toothbrush according to claim 1 wherein the profile of the ridge and the profile of the cavity are each in the shape of a V.

4. The toothbrush according to claim 1 further including means to maintain the brush body and the brush back in a slightly separated position near the head of the brush so that the part complementary to said cavity remains separate from said protective film prior to use of the toothbrush.

5. The toothbrush according to claim 4 wherein said means comprises a removable safety cap which covers at least the brush head;

the brush body and the brush back having grooves thereon;

said cap including on the inside thereof grooves which are complementary to grooves on the brush body and the brush back which retain the brush body and the brush back at a predetermined distance from each other.

6. The toothbrush according to claim 5 wherein said safety cap is in the shape of a slider whereby the removal of said safety cap causes the brush back and the brush body to approach each other, tear the protective film, and distribute the toothpaste.

7. The toothbrush according to claim 6 wherein said safety cap is in the shape of a cup.

8. The toothbrush of claim 4 wherein means to separate the brush body and the brush back is a tongue that can be pulled out and back in the area of the brush head, said tongue being initially attached to said brush body.

9. The toothbrush of claim 1 wherein locking means are provided on said brush body and on said brush back to secure the brush body and the brush back in immobilized relation to one another.

10. The toothbrush of claim 1 wherein the dose of toothpaste is in the shape of a small pocket which is fitted into the cavity in the back of the brush.

* * * * *